United States Patent [19]

Theurer

[11] Patent Number: 4,476,786

[45] Date of Patent: Oct. 16, 1984

[54] BALLAST TAMPING MACHINE

[75] Inventor: Josef Theurer, Vienna, Austria

[73] Assignee: Franz Plasser Bahnbaumaschinen-Industriegesellschaft m.b.H., Vienna, Austria

[21] Appl. No.: 347,434

[22] Filed: Feb. 10, 1982

[30] Foreign Application Priority Data

Mar. 9, 1981 [AT] Austria ..... 1085/81

[51] Int. Cl.[3] ..... E01B 27/16

[52] U.S. Cl. ..... 104/12; 104/10; 403/61; 403/166

[58] Field of Search ..... 104/7 R, 7 B, 10, 12; 403/61, 166, 229

[56] References Cited

U.S. PATENT DOCUMENTS

| | | | |
|---|---|---|---|
| 890,659 | 6/1908 | Kellner | 104/12 |
| 1,980,704 | 11/1934 | Scheuchzer | 104/12 |
| 3,625,156 | 12/1971 | Anderson | 104/12 |
| 3,807,311 | 4/1974 | Plasser et al. | 104/12 |
| 4,221,169 | 9/1980 | Theurer | 104/12 |

FOREIGN PATENT DOCUMENTS

| | | | |
|---|---|---|---|
| 938498 | 12/1973 | Canada | 104/12 |

*Primary Examiner*—Randolph Reese
*Attorney, Agent, or Firm*—Kurt Kelman

[57] ABSTRACT

A machine for tamping ballast under a tie to which rails of a track are fastened, comprising a frame, and a tamping tool unit vertically adjustably mounted on the frame in vertical alignment with a respective one of the track rails. The unit includes a tamping tool carrier, respective pairs of tamping tools pivotally mounted on the carrier on the field side and the gage side of the respective track rail for immersion in the ballast adjacent a point of intersection of the tie and rail where the track is supported on the ballast, a single hydraulic reciprocating drive connecting the tamping tools of each pair for pivoting the tamping tools of the pair independently of each other and asynchronously towards and away from each other, a single vibrating drive connected to the tamping tools of each pair for vibrating the tools. The tamping tools of each pair are centered by a separate elastic force-transmitting element supported on the carrier and biasing a respective one of the tamping tools in the direction of reciprocation thereof.

8 Claims, 8 Drawing Figures

I
II
III

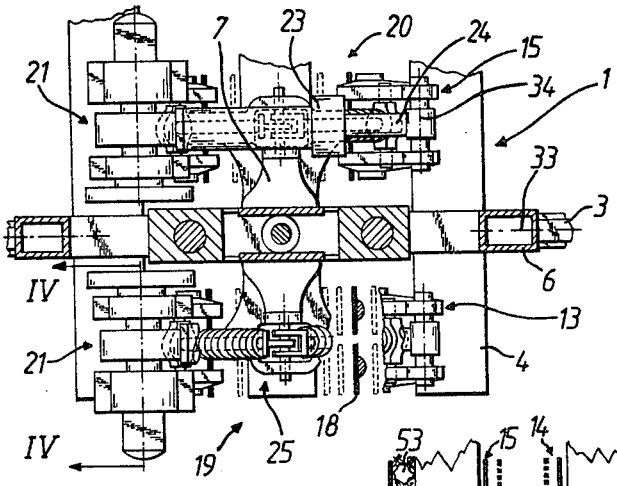
Fig. 3
Fig. 8
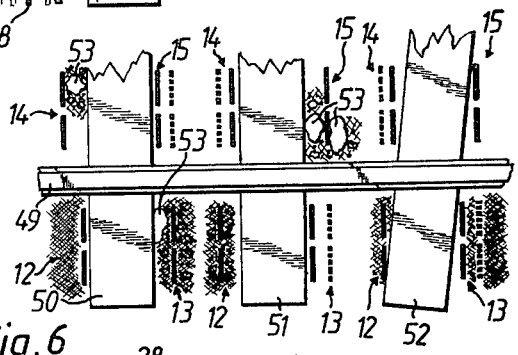
Fig. 4
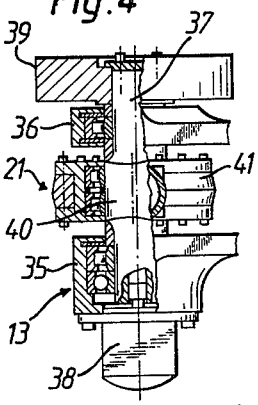
Fig. 6
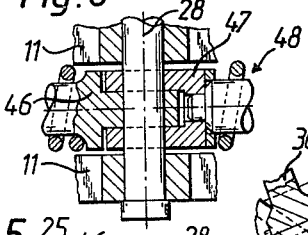
Fig. 7
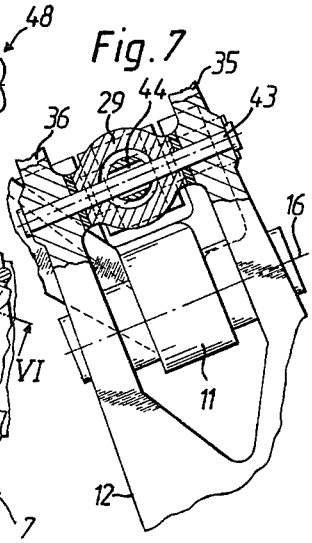
Fig. 5
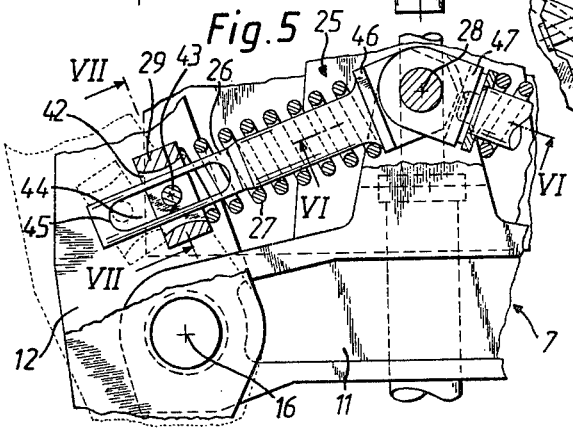

BALLAST TAMPING MACHINE

The present invention relates to improvements in a machine for tamping ballast under a tie to which rails of a track are fastened, comprising a frame and a tamping tool unit vertically adjustably mounted on the frame in vertical alignment with a respective one of the track rails. The unit includes a tamping tool carrier and respective pairs of tamping tools pivotally mounted on the carrier on the field side and the gage side of the respective track rail for immersion in the ballast adjacent a point of intersection of the tie and rail where the track is supported on the ballast.

U.S. Pat. No. 3,807,311, dated Apr. 30, 1974, discloses a mobile track tamping machine whose tamping tool unit has four tamping tools independently pivotal by a separate hydraulic reciprocating drive associated with each tool. Each pair of pivotal tamping tools arranged for immersion on the gage or field side of the rail adjacent the point of intersection of the tie and rail is connected to a common vibrating drive arranged centrally between the tools of the pair. In this manner, the four tamping tools may be reciprocated independently of each other and their reciprocating path depends on the ballast conditions encountered by each tool during the tamping operation. However, the same reciprocating force is effective at the tamping jaws of all four tools. This produces the desired degree of ballast compaction in the range of each tamping jaw, independent of the local ballast condition, the respective reciprocating path and any obstacles present in the ballast. This tamping technique has become known to those skilled in the art as the so-called "asynchronous tamping" used in ballast tamping for several decades, as compared to the reciprocation of pairs of tamping tools by threaded spindle drives which snychronously move the tamping tools together. Ballast tamping machines operated on the asynchronous tamping principle have been very successful all over the world for tamping the ballast under a single tie at a time or under several ties simultaneously since highly and uniformly compacted ballast supports for a track may be obtained with asynchronous tamping over long stretches of track, even when the track bed conditions are very bad and uneven or the ties are not parallel to each other.

U.S. Pat. No. 4,221,169, dated Sept. 9, 1980, discloses a relatively light-weight type of track tamper designed primarily for work in switches. This switch tamper has a tamping tool unit arranged forwardly of the front wheels and its four tamping tools may be laterally pivoted so that the tamping jaws may be immersed in the ballast at a switch. Pairs of tamping tools straddling a respective rail and being immersible in the ballast at the field and gage sides of the rail in a crib adjacent the tie to be tamped are mounted on a common, fork-shaped holder which, in turn, is pivotal on the tamping tool carrier about an axis extending transversely to the track. A common crank drive for vibrating all four tamping tools is mounted at the upper end of one of the tamping tool holders and the upper end of the other tamping tool holder is linked thereto by means of a piston-cylinder adjustment drive. Furthermore, the tamping tool carrier is equipped with guide means having resiliently yielding abutments for the two tamping tool holders to hold them in a substantially symmetrical position relative to the longitudinal center of the tamping tool unit. While all the tamping tools in the tamping tool unit of the machine described in U.S. Pat. No. 3,807,311 are fully asynchronously reciprocable, the lighter machine disclosed in. U.S. Pat. No. 4,221,169 provides asynchronous operation only of the pair of tamping tools mounted on the one holder and immersed in one crib relative to the pair of tamping tools mounted on the other holder and immersed in the opposite crib on the other side of the tie to be tamped. What could be called "half asynchronous tamping" with this unit has been successfully used in smaller tampers and has been commercially quite acceptable because of its simple and correspondingly economical structure of the relatively light tamping heads. However, the full advantage of fully asynchronous tamping cannot be obtained with this structure.

It is the primary object of this invention to provide a heavy ballast tamping machine of the first-indicated type whose tamping tool unit is of relatively simple structure while providing all the advantages of fully asynchronous tamping provided by the indepently asynchronous tamping movement of all the tamping tools.

The above and other objects and advantages are accomplished according to the invention with a single hydraulic reciprocating drive connecting the tamping tools of each pair of tools pivotally mounted on the tamping tool carrier on the field side and the gage side of a respective track rail for pivoting the tamping tools of the pair independently of each other and asynchronously towards and away from each other. A single vibrating drive is connected to the tamping tools of each pair for vibrating the tools, and centering means for the tamping tools of each pair comprises a separate elastic force-transmitting element supported on the carrier and biasing a respective one of the tamping tools in the direction of reciprocation thereof.

While this structure fully maintains the full asynchronous tamping principle for all the tamping tools and the independent reciprocation of each tool, with all its attendant advantages, the unit is much simpler than known tamping tool units incorporating this principle, dispensing with separate reciprocating drives for each tool, including the structural components, hydraulic conduits, bearings and connections for each such drive. Furthermore, this simplified structure of the tamping tool unit brings with it a saving in space and weight. In addition, this structure also provides a novel tamping effect providing automatic distribution not only of the reciprocating path but also of the vibrating motion, particularly the total amplitude of vibration, to each tamping tool of each pair of reciprocating tamping tools, even if the ballast conditions change. This effect is derived from the fact that, while the elastically yielding centering means associated with each pair of tamping tools prevents substantial deviations of the individual tamping tools from their symmetrical position, it permits some equalizing movements of the tamping tools with respect to the tamping tool carrier when the individual tools encounter different ballast conditions, for example uneven encrustation of the ballast or a local obstacle, such as a large stone. When the movement of one tool is inhibited because it encounters a harder ballast portion, particularly during the immersion of the tamping tools into the ballast, the amplitude of vibration of the other tamping tool of the pair may be as much as doubled, depending on the type and extent of jamming of the one tool. This amplification of the amplitude of vibration and possibly also of the reciprocatory force of the one tamping tool of the pair facilitates the immersion of this tool into the ballast and thereby also enhances the force of immersion of the other tool so that this other tool is able to overcome the resistance to its immersion by the encrusted or otherwise obstructed ballast it encounters. When the obstruction in the range of the other tamping tool cannot be overcome, i.e. if the immerging tool encounters a large stone, the asynchronous tamping causes the one tamping tool to increase its reciprocatory path and thus to take over the tamping until the desired degree of compaction has been attained. If an immerging tamping tool were lodged between two such obstacles so that it is incapable of vibrating, the amplitude of vibration of the other tool of the pair may be as much as doubled. In this way, the structure of the present invention provides an altogether novel ballast tamping principle combining the advantages of full and automatic control of the vibratory motions of the tamping tools with those of asynchronous tamping.

The above and other objects, advantages and features of this invention will become more apparent from the following detailed description of a now preferred embodiment thereof, taken in conjunction with the accompanying drawing wherein:

FIG. 3 is a top view partially along section line III—III of FIG. 1;

FIG. 4 shows a bearing of the tamping tool unit, partially in section along line IV—IV of FIG. 3;

FIG. 5 is an enlarged end view, partially in section, of the range of the tamping tool unit wherein the centering means in mounted;

FIG. 6 is a sectional view along line VI—VI of FIG. 5;

FIG. 7 is a side elevational view of the outer bearing of the elastic centering means on the associated tamping tool, partially in section along line VII—VII of FIG. 5; and FIG. 8 is a schematic top view of a tamping point along the track, showing the position of the tamping jaws encountering differing ballast conditions.

Figures 1, 2:
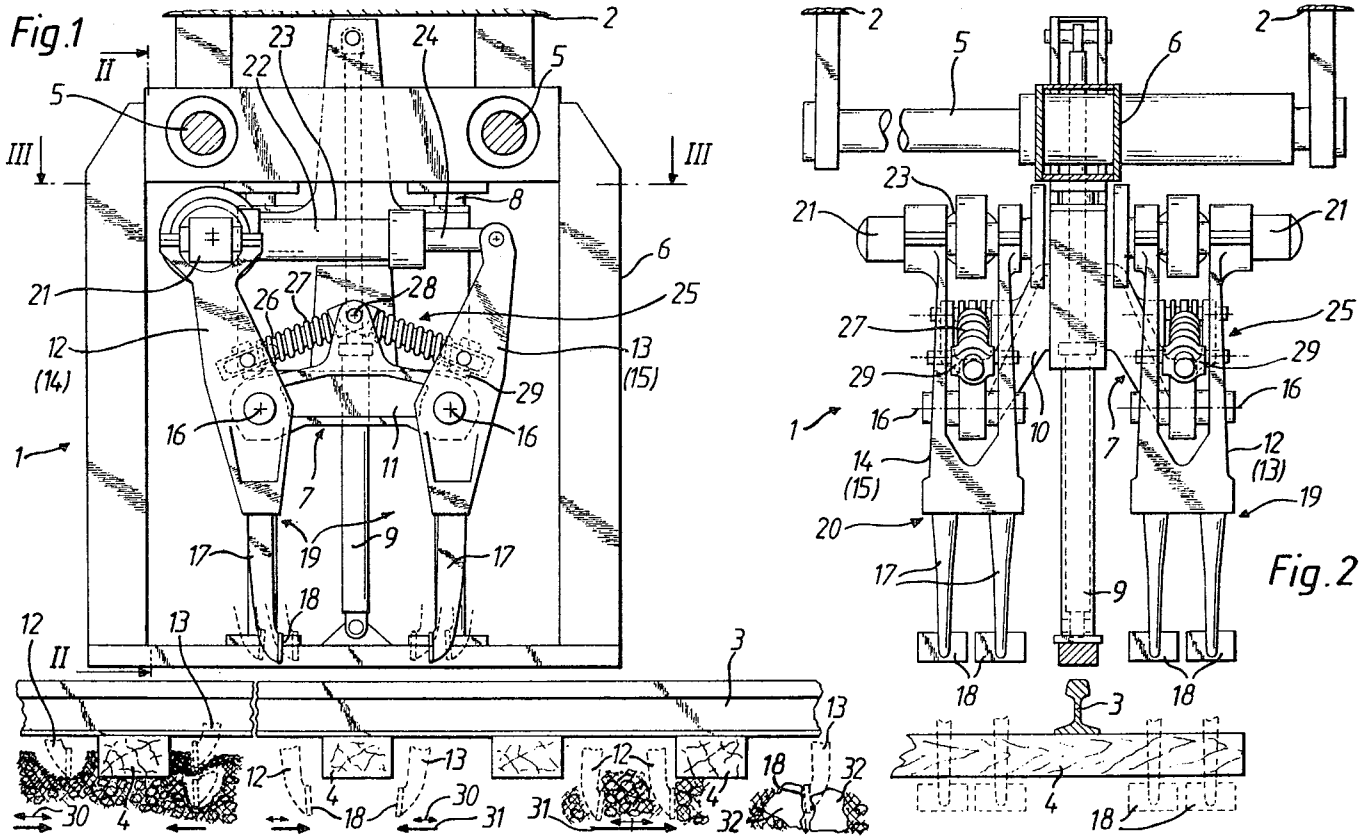
FIG. 1 is a side elevation view of tamping tool unit vertically adjustably mounted on the frame of a ballast tamping machine.
FIG. 2 is an end view of this unit, seen in the direction of arrow II in FIG. 1.

Referring now to the drawing and first to FIGS. 1 and 2, there is shown a machine for tamping ballast under tie 4 to which rails 3 of a track are fastened. Only frame 2 of the machine has been illustrated and tamping tool unit 1 is vertically adjustably mounted on frame 2 in vertical alignment with a respective track rail 3. Ballast tamping machine frame 2 carries two transversely extending beams 5, 5 which transversely displaceably support rectangular frame 6 enabling tamping tool unit to be laterally adjusted in relation to rail 3. Two vertical guide columns 8, 8 vertically adjustably mount tamping tool carrier 7 on frame 6, centrally positioned hydraulic drive 9 enabling the tamping tool carrier of tamping tool unit 1 to be vertically adjusted in relation to frame 6 which forms part of machine frame 2. Tamping tool carrier 7 has two carrier arms 10, 10 extending transversely to the track and being substantially symmetrically positioned relative to a central vertical axis of the unit passing through rail 7 when the unit is in operating position and carrier plates 11, 11 are affixed to the outer ends of the carrier arms, for instance by welding. Respective pairs 19 and 20 of tamping tools 12, 13 and 14, 15 are pivotally mounted on carrier plates 11 on the field side and the gage side of respective track rail 3 for immersion in the ballast adjacent a point of intersection of tie 4 and rail 3 where the track is supported on the ballast. As shown, the tamping tools are comprised of two-armed tool holders whose pivots 16, 16 mount the tools at respective ends of the carrier plates, and two tools 17 with tamping jaws 18 are replaceably mounted in the holders. Single hydraulically operated crank drive 21 is connected to the tamping tools of each pair 19, 20 for vibrating the tools, the vibrating drive being mounted on the upper arm end of tamping tool 12 of pair 19 and tamping tool 14 of pair 20. A single hydraulic reciprocating drive 23 connects tamping tools 12, 13 and 14, 15 of each pair 19 and 20 for pivoting the tamping tools of each pair independently of each other and asynchronously towards and away from each other. The illustrated reciprocating drive is comprised of cylinder 22 linked to vibrating drive 21 at the upper end of the one tamping tool and piston rod 24 linked to the upper end of the other tamping tool. As particularly shown in FIG. 2, the reciprocating and vibrating drives associated with the respective pairs of tamping tools on the field and gage sides of rail 3 are mirror-symmetrically arranged with respect to a vertical plane passing through the rail.

The illustrated construction of the reciprocating and vibrating drives is very simple and forms a drive unit of mechanically connected hydraulic drives for the reciprocation and vibration of the tamping tools of each pair. It combines the advantage of using known and commercially available components of proven effectiveness with all the advantages of linking the tamping drives to the upper tool ends for obtaining the previously described novel operating effects. The symmetrical arrangement produces symmetrical load conditions reducing the wear on the moving parts considerably.

According to the present invention, the tamping tool unit includes elastically yielding centering means 25 for the tamping tools of each pair 19, 20 and the centering means comprises a separate elastic force-transmitting element 26, 27 supported on tamping tool carrier 7 and biasing a respective one of the tamping tools in the direction of reciprocation thereof. Centering means 25 serves to position the tamping tools of each pair substantially mirror-symmetrically in relation to a vertical center plane of tamping tool unit 1 extending transversely to the track between the tamping tools of pairs 19, 20 and has further functions described hereinafter. The elastic force-transmitting elements illustrated herein are comprised of two rod-shaped spring carriers 26 having one of their ends supported at common support point 28 and another end extending to a respective one of the tamping tools at a point immediately above pivot 16 thereof. Coil springs 27 are arranged under compression on spring carriers 26 for superimposing a bias on the vibrating tamping tools. Spring 27 bear independently against an upper end of spring carriers 26 supported on tamping tool unit carrier 7, on the one hand, and against abutment 29 linked to the point immediately above the tamping tool pivot, on the other hand. The inner ends of spring carriers 26 are pivotal on carrier plate 11 about common support point 28.

The bias imparted to the tamping tools by this centering means enhances the reciprocating force exerted upon the tools and thus tends to increase the tamping pressure. The outward movement of the tamping tools at the end of the tamping operation will serve in this structure to load compression springs 27, i.e. it is used to store the required spring bias used in the subsequent tamping operation. Thus, given the dimensions of the reciprocating drive used for the tamping tools of the unit, the structure provides an additional source of tamping pressure for the compaction of the ballast during the closing pincer movement of the tamping tools so that the advantages of the novel asynchronous tamping obtained with the tamping tool unit of this invention are further enhanced and its effectiveness is increased.

Tamping tool unit 1 operates according to the fully asynchronous tamping principle which provides fully independent reciprocating paths for tamping tools 12 to 15, which depend on the prevailing ballast conditions encountered by each tool during reciprocation in the direction of the tie lying between each pair of tools, while the identical reciprocating force is applied to tamping jaws 18 of all the tools. Because of the described structure of unit 1, the vibratory movements imparted to the tamping tools are also fully independent of each other. To provide a better understanding of this new tamping technique, the bottom portion of FIG. 1 schematically illustrates the conditions of movement of tamping tools 12, 13 of pair 19 in three different tamping operations under different ballast conditions, the tamping tools and their tamping jaws 18 being shown in broken lines. The center position shows tamping of substantially uniformly and relatively loosely compacted ballast under tie 4. Such regular ballast conditions in the two cribs adjacent the tie to be tamped produce substantially conforming conditions for the immersion of all the tamping tools into the ballast and for their vibration and reciprocation during tamping. Therefore, the amplitude of vibration of tamping jaws 18 of tools 12, 13 will be the same, as indicated by double-headed arrows 30. As further indicated by arrows 31, independently of the vibrations, the inward movement path of the tamping tools under the pressure reciprocating drive 23 will also be the same for both tools. Centering means 25 will equally enhance the reciprocating force of both tamping tools, the bias of springs 27 being the same for both tools as drive 23 closes the tamping jaws in a pincer movement. As the tools press the ballast under tie 4, the force of spring 27 will be added to the force of drive 23 so that the total tamping force at jaws 18 will be increased.

The left side of the bottom of FIG. 1 illustrates tamping in a heavily encrusted and correspondingly hardened ballast bed. When tamping tool carrier 7 is lowered for immersion of the tamping tools into the ballast bed, tamping jaws 18 of tools 12, 13 vibrating at the same amplitude contact the surface of the ballast bed substantially simultaneously. Since the impact point of the tamping jaw of tool 13 is constituted by a particularly heavily encrusted ballast bed portion, the tamping jaw can only slightly penetrate into the ballast while the tamping jaw of tool 12 is capable of penetrating a little farther because the ballast bed portion contacted thereby is a little looser. In view of the very heavy encrustation of the ballast bed portion at the point of impact of the tamping jaw of tool 13, the same is at first immobilized and further vibration of the tool is prevented as it becomes lodged in the heavily encrusted ballast. Therefore, single vibrating drive 21 for pair 19 of tamping tools 12, 13 will impart vibrations solely to tool 12 and this doubled force will double the amplitude of vibrations of tamping tool 12. This very strong vibratory force will loosen the ballast and enable the tamping jaw of tool 12 rapidly to penetrate into the ballast, causing a substantially larger portion of the vertical load exerted upon unit 1 by drive 9 to be transmitted to tamping tool 13. This increased vertical force enables the tamping jaw of tool 13 to penetrate through the heavily encrusted ballast bed portion and to assume a more deeply immersed position in the ballast, as shown in the drawing, in which the tool is able to vibrate again. This will equalize the vibratory force between the two tamping tools. Because of this interaction between the two tools of each pair and the automatic distribution of the vibratory forces to the respective tamping tools of each pair, which is adapted to the respective ballast conditions under which each tool works, the tamping tools of unit 1 can be immersed to the desired depth even in heavily encrusted ballast beds. Independently of this, the independent reciprocating movement of the tamping tools according to the asynchronous tamping principle remains assured under these conditions, too. The synergistic work performed by the described type of vibration and reciprocation of the tamping tools results in a more uniform tamping quality even under unfavorable and changing ballast conditions.

The right side of FIG. 1 shows tamping at a point where tamping tool 13 is wedged between two large stones 32 which prevent the tool from moving. As described in connection with the preceding example, since tool 13 cannot be vibrated, the amplitude of vibration of tamping tool 12 will be doubled and this tool will penetrate more deeply into the loosened ballast, causing tool 13 also to move downwardly under the increased downward force exerted upon unit 1. Since tamping tools 17 are tapered towards their lower ends and, therefore, have a wedging effect on the ballast during their downward movement, the further immersion of tamping jaw 18 will force stones 32 apart, enabling both tamping tools to reach the desired immersion depth. Independent of the vibratory movements of the tamping tools, the jamming of tool 13 causes reciprocating drive 23 to exert its full force solely upon tamping tool 12, thus doubling the length of its reciprocating path, as indicated by arrow 31. This tool accordingly operates with a doubled vibratory and reciprocatory force. Therefore, although tool 13 is prevented from participating in the tamping operation because it is wedged between obstacles 32, 32, the full tamping force will be available through tool 12 for obtaining the desired compaction of the ballast under tie 4.

FIG. 3 illustrates the mirror-symmetric arrangement of reciprocating and vibrating drives 23 and 21 for pairs 19, 20 of the tamping tools with respect to vertical plane 33 passing through rail 3. As can be seen particularly in the upper portion of this figure, piston rod 24 of reciprocating drive 23 is pivoted at pivot 34 to the upper end of tamping tool 15. The upper ends of the tamping tools are comprised of forked tool holders having two arms and pivot 34 extends between these two arms for receiving the piston rod therebetween. Tamping jaws 18 are shown in full, heavy lines in their rest position and their intermediate and end reciprocatory positions are shown in broken lines.

FIG. 4 illustrates the arrangement of vibrating drive 21 on the forked upper end of tamping tool 13, arms 35, 36 of this forked tool upper end carrying anti-friction bearings for crank shaft 27 of vibrating drive 21. Upper tool end arm 35 carries hydraulic motor 38 connected to one end of shaft 27 for rotation thereof while shaft end 37 opposite thereto carries flywheel 39. Bearing 41 is rotatably mounted on crank 40 of crank shaft 37 and cylinder 22 of reciprocating drive 23 is affixed to bearing 41.

FIGS. 5 to 7 illustrate structural details of centering means 25. Abutment 29 for the outer end of spring 27 has a bore through which the outer end of spring carrier 26 passes and pin 43 projects from the tamping tool, i.e. extends between arms 35, 36 thereof, and engages elongated slot 44 in the outer end of spring carrier 26, this spring carrier end extending between the two arms of the forked tamping tools. In this manner, the outer end of the spring carrier is pivotally connected to the upper end of the tamping tool. Slot 44 guides spring carrier 26 and also delimits the pivoting movement of the tamping tool about pivot 16. In FIG. 5, the outer end position of tamping tool 12 is indicated in broken lines and, in this position, transverse pin 43 engages the outer end face of slot 44. As indicated in FIG. 6, carrier plate 11 of tamping tool unit carrier 7 defines forked bearing 48 receiving abutments 46 and 47 for the inner ends of springs 27, the two abutments being pivotally supported on pivot 28.

This preferred arrangement of centering means 25 provides a simple and robust guide for the spring carriers and tamping tools. It also forms a solid support for the spring bias forces on the spring carrier and the tamping tool, with the additional advantage of biasing the tamping tool holders parallel, and in the opposite direction, to the reciprocating force. The forked construction of the carrier plate for support of the spring abutments provides a simple bearing for the inner ends of the spring carriers, which is not only solid but also space-saving.

FIG. 8 illustrates the operation of tamping tools 12 to 15 at points of intersection of rail 49 and ties 50, 51, 52 some of which may not extend parallel to each other and where the ballast conditions may differ. For a better understanding, the schematically shown tamping jaws carried at the lower ends of the respective tamping tools have been designated by the reference numerals of the tools carrying them. The following conditions are encountered during the tamping of tie 50:

The ballast at the field side of rail 49 surrounding the outer end of tie 50 is encrusted, as indicated by heavy hatching. An obstacle which cannot be moved, such as stone 53, is lodged in the cribs into which tamping tools 13 and 14 are to be immersed. When the tamping tool unit is lowered, the tamping jaw of tool 13 closest to rail 49 comes into contact with stone 53. Since the ballast surrounding both tamping jaws of tool 13 is heavily encrusted, the vibratory motion of the tool is stopped. This, as has been previously explained in connection with FIG. 1, causes the amplitude of vibration of tamping tool 12 to be doubled, the encrusted ballast into which this strongly vibrating tool is immersed to be loosened and the tool to be rapidly immersed in the loosened ballast. Since stone 53 also prevents tamping tool 13 from being reciprocated towards tie 50, the reciprocating force exerted upon tool 12 also is doubled so that this tamping tool will compact the ballast under tie 50 to the desired degree with its doubled vibratory and reciprocatory force despite the unfavorable tamping conditions and the inability of one of the tamping tools of the pair to function. The ballast on the gage side of rail 49 is assumed to be rather loose but stone 53 provides an obstacle to the reciprocatory movement of tamping tool 14. However, since the ballast is relatively loose, the stone will not prevent the tool from vibrating. Therefore, tamping tools 14 and 15 will vibrate at substantially the same amplitude but the asynchronous reciprocating movement of the tools will cause the length of the reciprocatory path of tool 15 to be doubled.

The following tamping conditions are assumed at tie 51:

The ballast in the left crib on the field side of rail 49 is encrusted so that tool 12 will encounter resistance upon immersion, will penetrate only slightly into the ballast and will be immobilized in the encrusted ballast. Tamping tool 13 will accordingly vibrate with double force, providing such freedom of movement in a horizontal and vertical direction that it will rapidly penetrate into the ballast, the resultant downward thrust forcing tool 12 also down to the desired immersion depth. Further tamping then proceeds in the same manner as has been described in connection with the left side of the bottom of FIG. 1. As to the gage side of rail 49, two large stones 53, 53 are lodged in the right cribs and prevent reciprocatory movement of tamping tool 15 whose tamping jaw closest to the rail is wedged between the stones. The same condition will prevail, of course, if fixed parts of the track bed, such as posts cast in concrete or the like, are present in the cribs. The immobilization of tool 15 will cause tamping tool 14 to vibrate with twice its normal amplitude, to penetrate rapidly into the ballast, and the resultant downward thrust on tamping tool 15 will wedge the two stones apart to provide some freedom movement for this tool, too. This may be sufficient to overcome the resistance to movement offered by the stones and to permit reciprocation of tamping tool 15, too. Otherwise, the entire reciprocatory tamping force will be exerted by tamping tool 14 alone.

In the tamping of obliquely positioned tie 52, it has been assumed that the ballast on the field side of rail 49 is encrusted, providing poor tamping conditions. When the tamping tool unit is lowered for immersion of the tamping jaws into the ballast, the tamping jaws of tool 12 at the field side of the rail will be close to the longitudinal edge of tie 52 while the tamping jaws of the other tool 13 are relatively far removed from the tie at the time the tool is immersed in the ballast (position shown in broken lines). Thus, tool 12 is more or less wedged and immobilized between the encrusted ballast and tie 52 so that it cannot vibrate, causing the amplitude of vibration of tamping tool 13 to be doubled. The tamping then proceeds in the above-described manner, tamping tool 13 moving towards tie 52 into the position shown in full lines with increased vibratory force and a longer reciprocatory path. The tamping conditions at the gage side of the rail are assumed to be good, i.e. the ballast is relatively loose. Therefore, both tamping tools 14 and 15 penetrate relatively rapidly into the ballast while vibrating at the same amplitude. The tamping jaws of tool 15 are close to tie 52 while the tamping jaws of tool 14 are relatively far away from the tie at the time of immersion (see broken lines). When the reciprocating drive is actuated, tamping tool 14 will have a longer reciprocating path than tool 15, possibly the entire reciprocating path required for compacting the ballast between the tamping tools being apportioned to tool 15 to obtain the desired degree of compaction of the ballast.

I claim:

1. A machine for tamping ballast under a tie to which rails of a track are fastened, comprising (a) a frame, and (b) a tamping tool unit vertically adjustably mounted on the frame in vertical alignment with a respective one of the track rails, the unit including (1) a tamping tool carrier, (2) respective pairs of tamping tools mounted on the carrier for pivotal movement in the direction of the track independent of each other, the pairs of tamping tools being respectively arranged on the field side and the gage side of the respective track rail for immersion in the ballast adjacent a point of intersection of the tie and rail where the track is supported on the ballast, (3) a single hydraulic reciprocating drive connecting the tamping tools of each pair for pivoting the tamping tools of the pair independently of each other and asynchronously towards and away from each other in said direction, (4) a single vibrating drive connected to the tamping tools of each pair for vibrating the tools, and (5) centering means for the tamping tools of each pair, the centering means comprising a separate elastic force-transmitting element supported on the carrier and biasing a respective one of the tamping tools in the direction of reciprocation thereof.

2. The ballast tamping machine of claim 1, wherein the tamping tools are pivotal levers having an upper and a lower end and pivotally supported on the carrier substantially centrally intermediate their ends, the hydraulic reciprocating drive in comrpised of a cylinder linked to the upper end of one of the tamping tools and a piston rod linked to the upper end of the other tamping tools, and the vibrating drive is connected to the upper end of one of the tamping tools.

3. The ballast tamping machine of claim 2, where the vibrating drive is a hydraulically operated crank drive.

4. The ballast tamping machine of claim 2 or 3, wherein the vibrating drive is connected to the upper end of the one tamping tool linked to the cylinder.

5. The ballast tamping machine of claim 2, wherein the reciprocating and vibrating drives associated with the respective pairs of tamping tools on the field and gage sides of the rail are mirror-symmetrically arranged with respect to a vertical plane passing through the rail.

6. A machine for tamping ballast under a tie to which rails of a track are fastened, comprising (a) a frame, and (b) a tamping tool unit vertically adjustably mounted on the frame in vertical alignment with a respective one of the track rails, the unit including (1) a tamping tool carrier, (2) respective pairs of tamping tools mounted on the carrier for pivotal movement in the direction of the track independent of each other, the pairs of tamping tools being respectively arranged on the field side and the gage side of the respective track rail for immersion in the ballast adjacent a point of intersection of the tie and rail where the track is supported on the ballast, (3) a single hydraulic reciprocating drive connecting the tamping tools of each pair for pivoting the tamping tools of the pair independently of each other and asynchronously towards and away from each other in said direction, (4) a single vibrating drive connected to the tamping tools of each pair for vibrating the tools, and (5) centering means for the tamping tools of each pair, the centering means comprising a separate elastic force-transmitting element supported on the carrier and biasing a respective one of the tamping tools in the direction of reciprocation thereof, the elastic force-transmitting elements being comprised of spring carriers having one of their ends supported at a common support point on the carrier and another end extending to a respective one of the tamping tools at a point immediately above the pivot thereof, and springs arranged on the spring carriers for superimposing a bias on the vibrating tamping tools, the springs independently bearing against an upper end of the spring carriers supported on the tamping tool unit carrier, on the one hand, and against an abutment linked to said point immediately above the tamping tool pivot, on the other hand.

7. The ballast tamping machine of claim 6, wherein the other end of the spring carriers defines an elongated slot, and further comprising a pin projecting from the tamping tool and engaging the slot.

8. The ballast tamping machine of 6, wherein the upper tamping tool ends are comprised of forked tamping tool holders having two arms, the other ends of the spring carriers extending between the two arms of the forked tamping tool holders, the one ends of the spring carriers having abutments for the springs, the tamping tool unit carrier defining a forked bearing for the spring abutments.

* * * * *